US010168126B2

(12) United States Patent
Cronk

(10) Patent No.: US 10,168,126 B2
(45) Date of Patent: Jan. 1, 2019

(54) ROLLER

(71) Applicant: PEARSON ENGINEERING LIMITED, Newcastle upon Tyne (GB)

(72) Inventor: Richard Cronk, Newcastle upon Tyne (GB)

(73) Assignee: PEARSON ENGINEERING LIMITED, Newcastle upon Tyne (GB)

( * ) Notice: Subject to any disclaimer, the term of this patent is extended or adjusted under 35 U.S.C. 154(b) by 0 days.

(21) Appl. No.: 15/708,525

(22) Filed: Sep. 19, 2017

(65) Prior Publication Data

US 2018/0080746 A1 Mar. 22, 2018

(30) Foreign Application Priority Data

Sep. 19, 2016 (GB) ..... 1615925.3
Oct. 3, 2016 (GB) ..... 1616791.8

(51) Int. Cl.
*F41H 11/30* (2011.01)
*F41H 7/02* (2006.01)

(52) U.S. Cl.
CPC ..... *F41H 11/30* (2013.01); *F41H 7/02* (2013.01)

(58) Field of Classification Search
CPC ..... F41H 11/30; F41H 7/02; F41H 11/16
USPC ..... 89/1.13
See application file for complete search history.

(56) References Cited

U.S. PATENT DOCUMENTS 1,190,257 A * 7/1916 Henderson ..... F41H 11/30 15/179
1,278,382 A * 9/1918 Prendergast ..... E01C 19/264 172/170
2,455,636 A * 12/1948 Woolson ..... F41H 11/30 172/574
3,771,413 A * 11/1973 Sieg ..... F41H 11/30 89/1.13
5,313,868 A 5/1994 Wolf
5,786,542 A * 7/1998 Petrovich ..... F41H 11/30 89/1.11
7,100,489 B1 * 9/2006 Kendall ..... B60D 1/30 172/445.1
9,279,644 B2 * 3/2016 Cronk ..... F41H 11/18
9,303,957 B2 * 4/2016 Cronk ..... F41H 11/30
2006/0266576 A1 * 11/2006 Eckhoff ..... B65D 49/0635 180/14.1
2008/0092725 A1 * 4/2008 Simula ..... F41H 11/18 89/1.13

(Continued)

FOREIGN PATENT DOCUMENTS

EP 2784435 * 1/2014
EP 2784435 A1 10/2014

OTHER PUBLICATIONS

Nov. 29, 2016—(GB) Search Report—App 1616791.8.

*Primary Examiner* — Joshua E Freeman
(74) *Attorney, Agent, or Firm* — Banner & Witcoff, Ltd.

(57) ABSTRACT

A roller gang for mine clearance is provided. The roller gang comprises: a frame, at least three fixed wheels, wherein the fixed wheels are attached to the frame, the fixed wheels being fixed relative to the frame, a plurality of pivoting arms, wherein each of the pivoting arms is attached to the frame, and a plurality of remaining wheels, wherein the remaining wheels are respectively attached to the plurality of pivoting arms, the remaining wheels being movable relative to the frame.

24 Claims, 8 Drawing Sheets

(56) References Cited

U.S. PATENT DOCUMENTS

| | | | | |
|---|---|---|---|---|
| 2008/0236376 | A1* | 10/2008 | Reeves | F41H 11/24 89/1.13 |
| 2011/0048217 | A1* | 3/2011 | Ulrich | F41H 11/30 89/1.13 |
| 2011/0296976 | A1* | 12/2011 | Simula | F41H 11/30 89/1.13 |
| 2012/0186421 | A1* | 7/2012 | Firth | F41H 11/30 89/1.13 |
| 2013/0104727 | A1* | 5/2013 | Wiesman | F41H 11/12 89/1.13 |
| 2013/0327203 | A1* | 12/2013 | Cronk | F41H 11/30 89/1.13 |
| 2014/0157975 | A1* | 6/2014 | Firth | F41H 11/30 89/1.13 |
| 2015/0268012 | A1* | 9/2015 | Cronk | F41H 11/18 89/1.13 |
| 2015/0362295 | A1* | 12/2015 | Bradley | F41H 11/24 89/1.13 |

* cited by examiner

ROLLER

CROSS-REFERENCE TO RELATED APPLICATIONS

The present application claims priority to GB1615925.3 filed on 19 Sep. 2016, and GB1616791.8 filed 3 Oct. 2016, both of which are hereby incorporated by reference in their entirety for any and all non-limiting purposes.

FIELD OF THE INVENTION

The present invention relates generally to mine clearance and particularly to a mine clearance roller, for example provided as front end equipment for an armoured vehicle.

BACKGROUND OF THE INVENTION

When an armoured vehicle traverses over an unexploded mine, the mine may be detonated and damage caused to the armoured vehicle and people within.

A mine roller or mine trawl is a demining device mounted on a tank or armoured personnel carrier, designed to detonate anti-tank mines. It allows engineers to clear a lane through a minefield.

The device is often composed of a fork or two push arm assemblies fitted to the front of a tank hull, with two banks of rollers that can be lowered in front of the tank's tracks. Each roller bank has several heavy wheels studded with short projecting steel girders, which apply a higher ground pressure than the tank's tracks. This ensures the explosion of pressure-fused anti-tank mines, which would otherwise explode under the track itself.

The present application provides a roller gang and roller for improving safety based on effective mine clearance.

SUMMARY OF THE INVENTION

The present invention relates generally to mine clearance and particularly to a mine clearance roller apparatus, for example provided as front end equipment for an armoured vehicle.

According to a first aspect there is provided a roller gang for mine clearance, the roller gang comprising a frame, at least three fixed wheels, wherein the fixed wheels are attached to the frame, the fixed wheels being fixed relative to the frame, a plurality of pivoting arms, wherein each of the pivoting arms is attached to the frame, and a plurality of remaining wheels, wherein the remaining wheels are respectively attached to the plurality of pivoting arms, the remaining wheels being movable relative to the frame.

The roller gang may be arranged for traversing rough terrain.

The at least three fixed wheels may be attached to the frame in a triangular arrangement.

The remaining wheels may be arranged in two sets of parallel wheels.

The remaining wheels may have an attachment point with the pivoting arms to satisfy a load distribution requirement for the remaining wheels and/or the fixed wheels.

The plurality of pivoting arms may be bent to prevent the ends of each of the pivoting arms from hitting the ground and whilst still satisfying the required load distribution.

The load distribution may be an even load distribution.

The remaining wheels may be attached to the respective pivoting arms at a location along the pivoting arms such that a ground contact load under all wheels in the gang are identical.

The remaining wheels may be attached to the respective pivoting arms and may individually move up and down to maintain contact with rough terrain over which the apparatus is traversed.

The pivoting arms may be heavier that the frame, fixed wheels and remaining wheels.

One or more of the fixed wheels and/or the remaining wheels may be offset in height with respect to the other of the fixed wheels and/or the remaining wheels.

The roller gang may comprise an odd number of wheels.

At least one of the pivoting arms may be further connected to the frame by a tether. The tether may absorb blast energy in the event of a mine blast.

The roller gang may further comprise a boom attached to the frame. The roller gang and boom may be arranged for use as a front-end equipment for an armoured vehicle. The armoured vehicle may be a tank or a bulldozer.

According to a second aspect there is provided a roller for mine clearance, the roller comprising at least two roller gangs as described herein.

The at least two roller gangs of the roller may be positioned adjacent each other with one roller gang facing in a direction of travel and the other roller gang facing in an opposite direction.

At least two roller gangs may be aligned to form at least two substantially continuous rows of wheels.

The at least two continuous rows of wheels may have a gap between adjacent wheels that is substantially the same.

The at least two roller gangs may be pivotally attached to a respective boom. A tie rod may further connect each respective boom together via ball joints.

The at least two roller gangs may be free to pivot and roll individually whilst maintaining an approximately constant separation between the at least two roller gangs.

Each respective boom may be further attached to a vehicle bracket via a ball joint.

According to a third aspect there is provided a system for mine clearance, the system comprising a roller as described herein and a powered actuator for steering the roller.

The roller may be steerable between left and right positions of the roller ahead of a vehicle.

The system may further comprise a mechanism to push-down and/or lift-up at least one of the rows of wheels.

A further aspect provides a roller comprising one or more roller gangs, the or each gang having an odd number of wheels. Roller gangs may be identical.

Each roller gang may have three wheels fixed directly to the frame with the remaining wheels attached to heavy pivoting arms. The pivoting arms being attached to the frame.

The three fixed wheels may be arranged in a widely spaced triangle (in plan view) so these wheels and the frame create a stable three wheeled vehicle.

As the roller gang traverses rough terrain, the three fixed wheels follow the terrain and make the frame tip left or right and pitch fore or aft to follow the terrain profile.

In some embodiments the wheels attached to the pivoting arms can individually move up and down to maintain contact with the rough terrain.

The wheels attached to the pivoting arms may be attached at a location along these arms such that the ground contact load under all wheels in the gang are identical.

To explain this phenomena, image the wheels were attached at the end of the heavy pivoting arms, and that these arms were straight and horizontal. The ground contact load at each pivoting wheel would be the mass of each wheel plus half the mass of its heavy arm. The other half of the arm mass would be supported by the frame. The ground contact load of the three fixed wheels would be the mass of these three wheels, plus the mass of the frame plus half the mass of all the pivoting arms.

If, however, the pivoting wheels were attached at the midpoint of the heavy arms, the ground contact load at each pivoting wheel would the mass of the wheel plus the whole mass of the pivoting arm (i.e. more than before) and the ground contact load of the three fixed wheels would be the mass of these three wheels, plus the mass of the frame (i.e. less than before).

As the point of attachment of the wheels to the pivot arm is moved further towards the frame pivot, the ground contact load of these wheels will further increase and the ground contact load of the three fixed wheels will further reduce.

In one embodiment, these heavy pivot arms are bent, this prevents the ends of the arms hitting the ground whilst still satisfying the mass distribution required.

The pivoting arms may also connected to the frame by a chain (or similar) which limits up and down travel. This chain may be designed to plastically stretch in the event of a blast thus absorbing blast energy.

In a roller assembly two roller gangs are positioned next to each other with one roller gang facing in the direction of travel and the other roller gang in the opposite direction. The staggered wheel patterns of both nest together (see plan view) and generate a continuous row of wheels with same gap between each wheel (see front view).

Each roller gang is pushed ahead of the vehicle by a boom. The boom is pivotally attached to the roller gang frame. The boom is attached to the vehicle by a ball joint.

A tie rod connects the two booms together by attaching (via ball joints) to each boom. Thus the roller gangs are free to pivot and roll individually but the separation between them is maintained approximately constant.

The system may have a powered 'steering' actuator to control the left/right position of the roller ahead of the vehicle.

The system may have a functionality to pushdown/lift up one or other of both of the front or rear row of roller wheels.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

BRIEF DESCRIPTION OF THE DRAWINGS

The present invention will now be more particularly described, by way of example, with reference to the accompanying drawings, in which.

DESCRIPTION

Figure 1A:
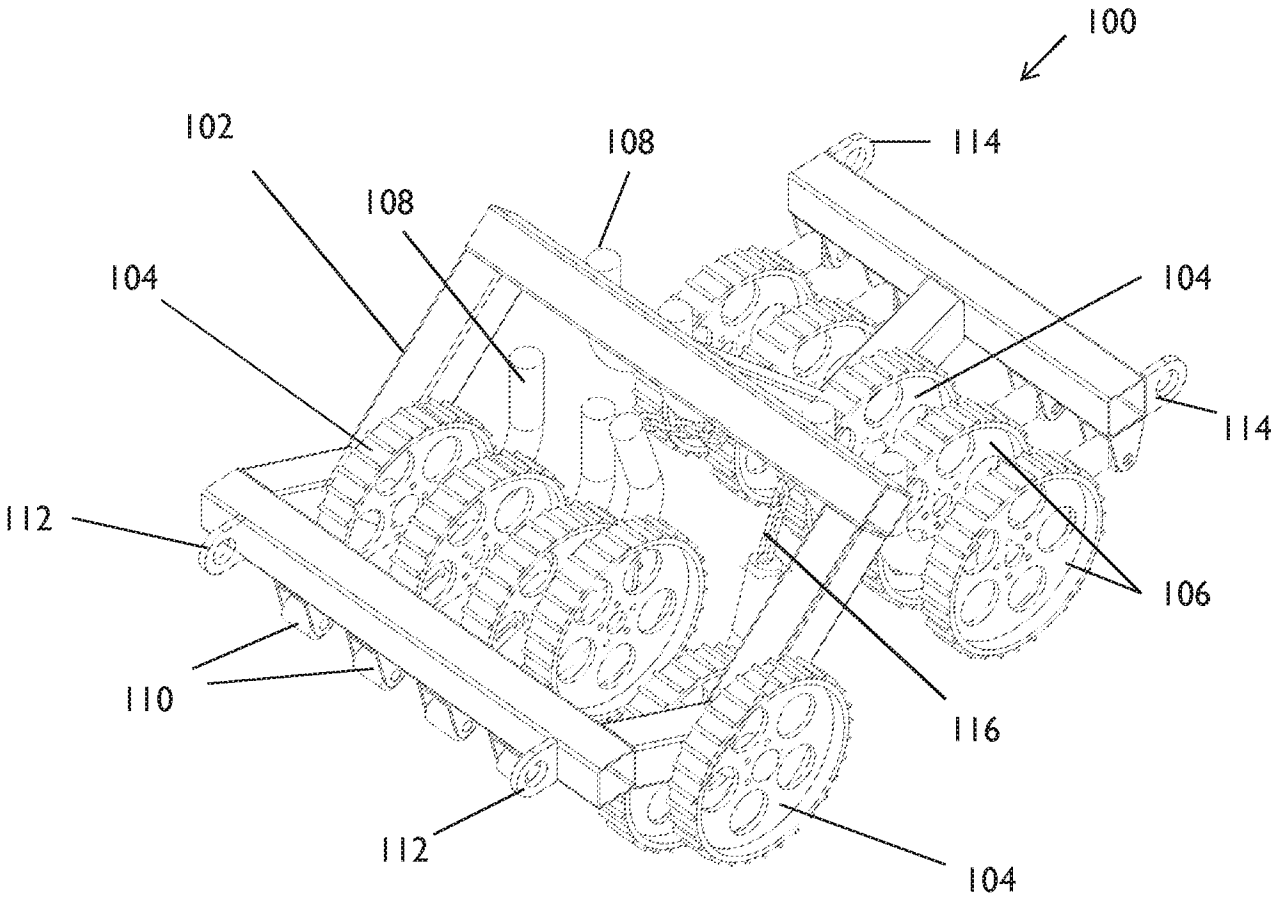
FIGS. 1A-C are schematics showing a roller gang according to an embodiment.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

A roller gang (100) is provided. Each roller gang comprises a frame (102), a plurality of wheels (104, 106) and a plurality of pivoting arms (108). Some of the wheels may be fixed (104) to the frame and some of the wheels (106) may be attached to the pivoting arms (108). Each roller gang (100) may have an odd number of wheels.

In the embodiment shown in FIG. 1A the roller gang (100) has three wheels (104) fixed directly to the frame (102) with the remaining wheels (106) attached to heavy pivoting arms (108). The pivoting arms (108) are attached to the frame (102) at pivoting attachment points (110) along the frame (102).

At either end of the roller gang (100) are attachment points (112, 114). Each of the attachment points (112, 144) may allow coupling of the roller gang (100) to a vehicle, for example via a boom.

The pivoting arms (108) may be further connected to the frame (102) by a tether or a chain (116) (or similar) which limits up and down travel of the pivoting arm (108) and wheel (106).

Figure 1B:
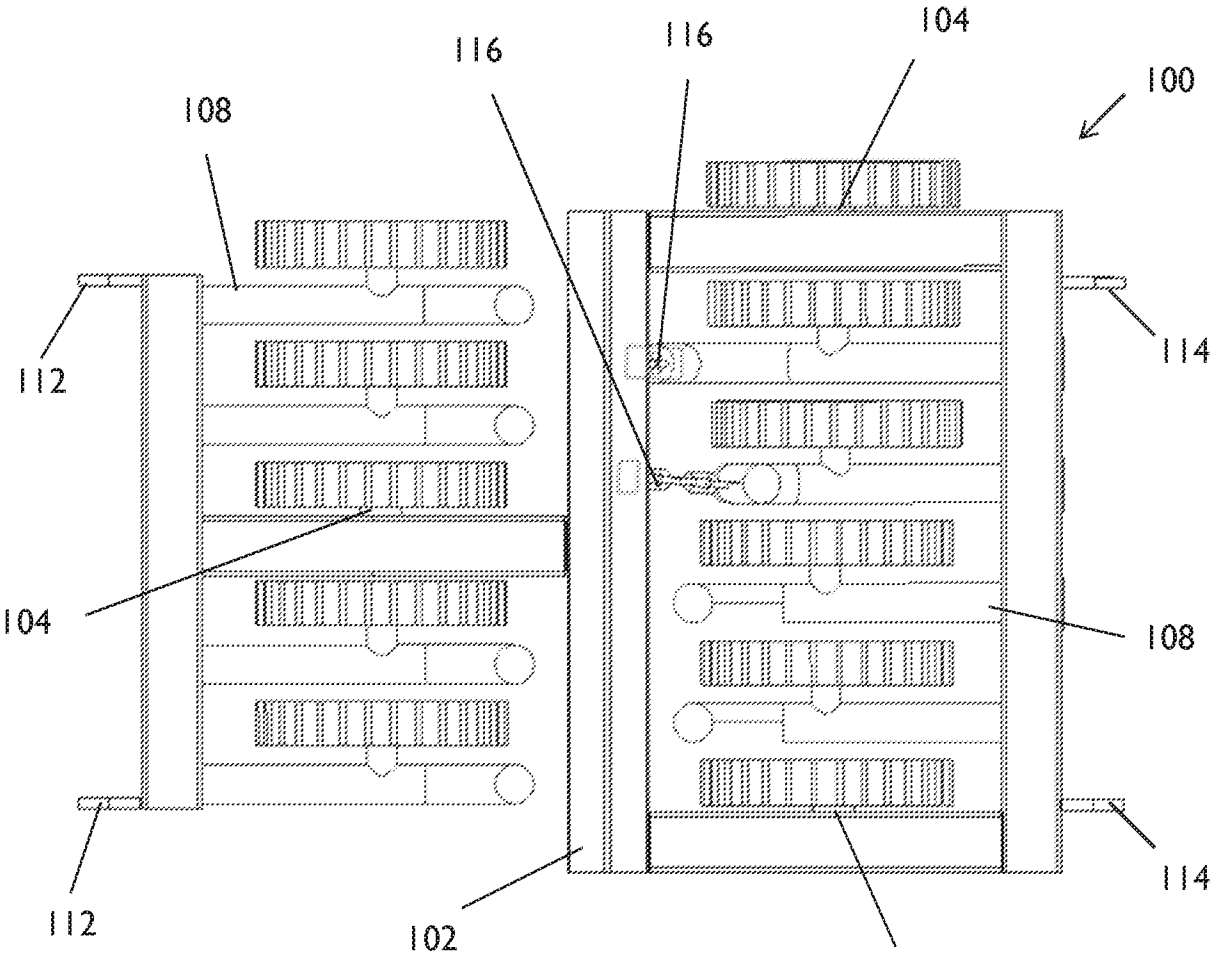

FIG. 1B shows the roller gang (100) of FIG. 1A in plan view.

Figure 1C:
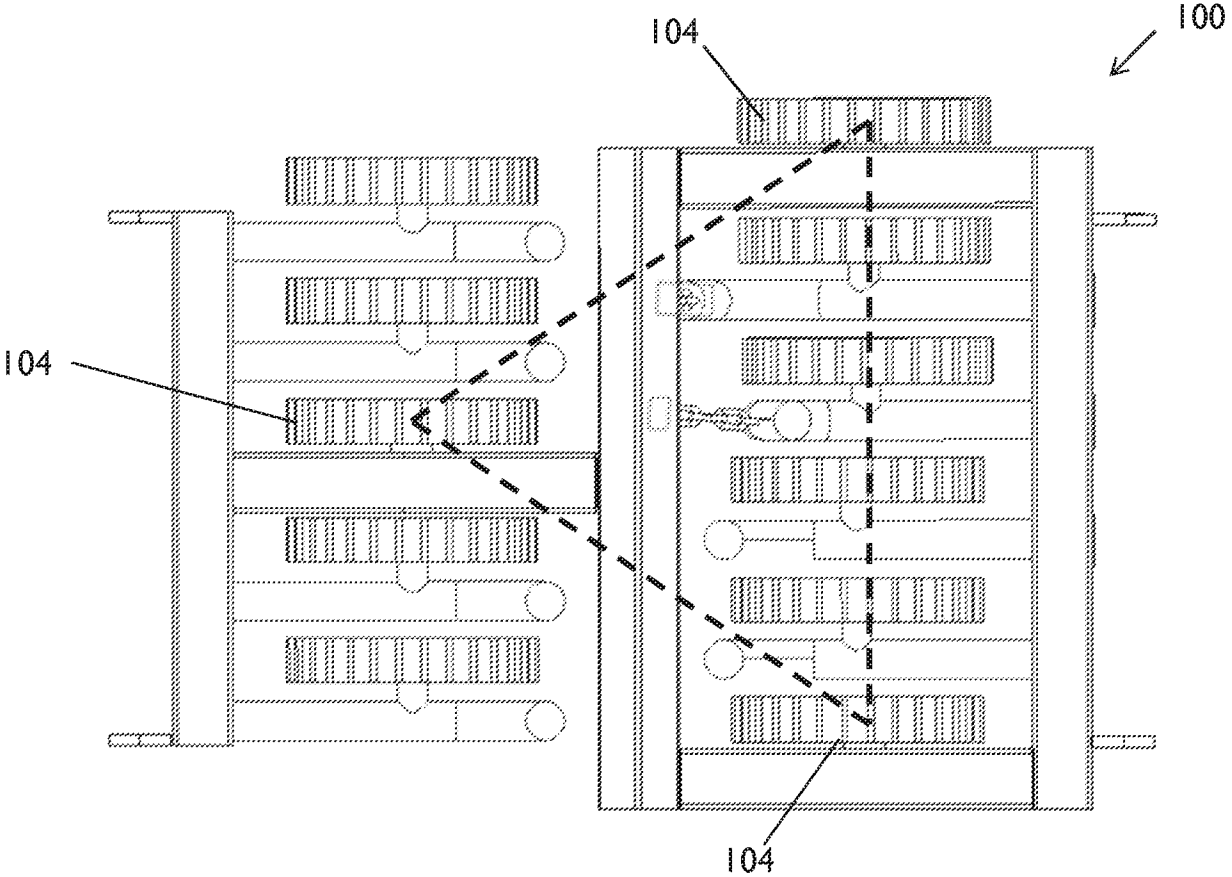

The three fixed wheels (104) are arranged in a widely spaced triangle. This is shown in the plan view of FIG. 1C. The triangular spacing is such that these wheels (104) and the frame (102) create a stable three wheeled vehicle.

As each roller gang (250, 260) traverses rough terrain, the three fixed wheels (104) follow the terrain and make the frame (102) tip left or right and pitch fore or aft to follow the terrain profile.

The wheels (106) attached to the pivoting arms (108) can individually move up and down to maintain contact with the rough terrain.

The wheels (106) attached to the pivoting arms (108) are attached at a location along these arms such that the ground contact load under all fixed and/or remaining wheels (104, 106) in the roller gang are identical.

To explain this phenomena, imagine the wheels (106) were attached at the end of the heavy pivoting arms (108), and that these arms were straight and horizontal. The ground contact load at each pivoting wheel (106) would be the mass of each wheel (106) plus half the mass of its heavy arm (108). The other half of the arm mass would be supported by the frame (102). The ground contact load of the three fixed wheels (104) would be the mass of these three wheels (104), plus the mass of the frame (102) plus half the mass of all the pivoting arms (108).

If, however, the pivoting wheels (106) were attached at the mid-point of the heavy arms (108), the ground contact load at each pivoting wheel (106) would be the mass of the wheel (106) plus the whole mass of the pivoting arm (108) (i.e. more than before) and the ground contact load of the three fixed wheels (104) would be the mass of these three wheels (104), plus the mass of the frame (102) (i.e. less than before).

As the point of attachment of the wheels (106) to the pivot arm (108) is moved further towards the frame pivot (110), the ground contact load of these wheels (106) will further increase and the ground contact load of the three fixed wheels (104) will further reduce.

In the embodiment shown, these heavy pivot arms (108) are shown bent, this prevents the ends of the arms hitting the ground whilst still satisfying the mass distribution required.

The pivoting arms (108) are also connected to the frame (102) by a chain (or similar) which limits up and down travel. This chain may be designed to plastically stretch in the event of a blast thus absorbing blast energy.

Figure 2A:
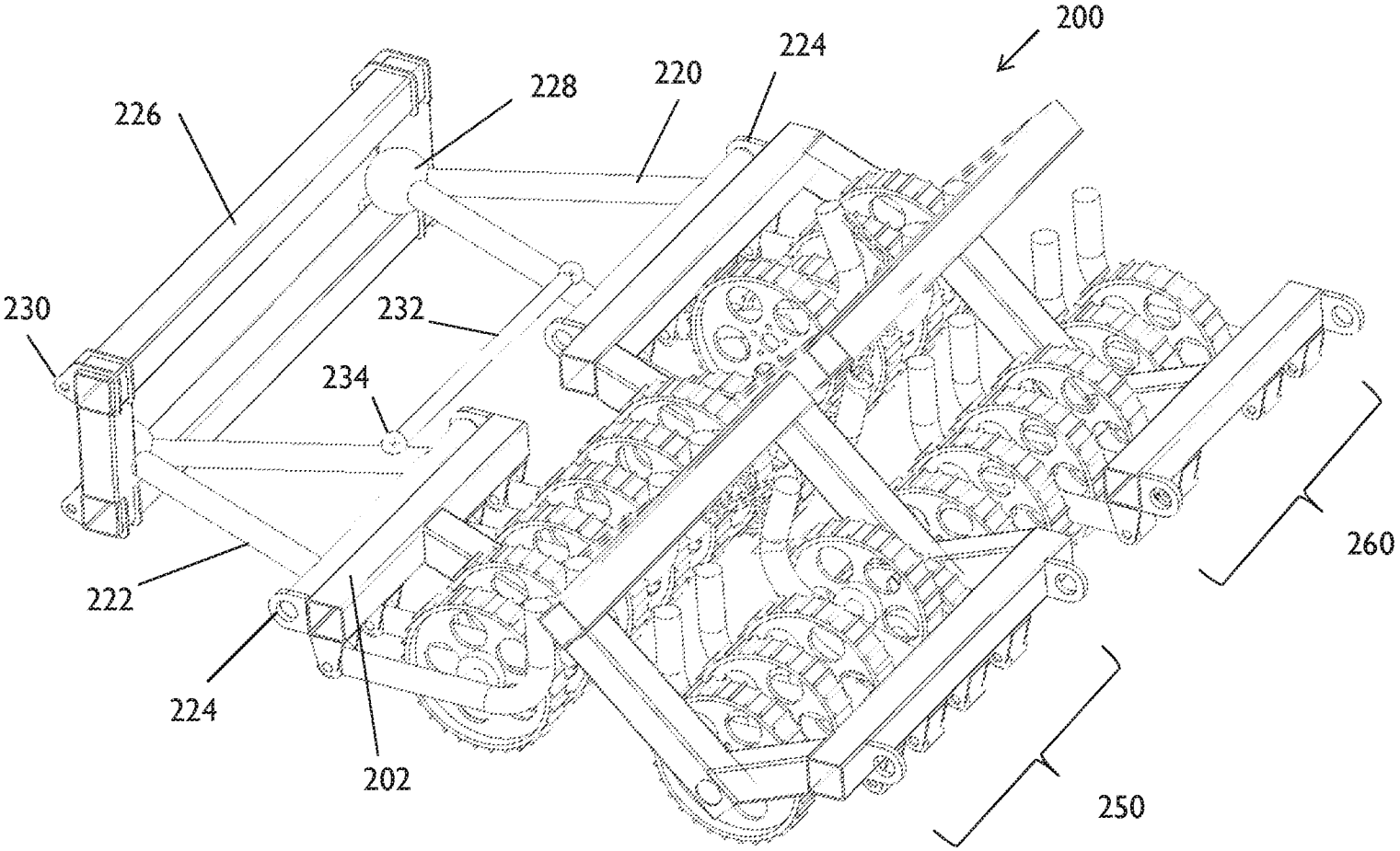
FIGS. 2A-E are schematics showing a roller according to an embodiment.

The roller gangs may be combined to form a roller (200) as shown in FIG. 2A. The roller (200) may consist of one or more identical roller gangs (100).

Figure 2B:
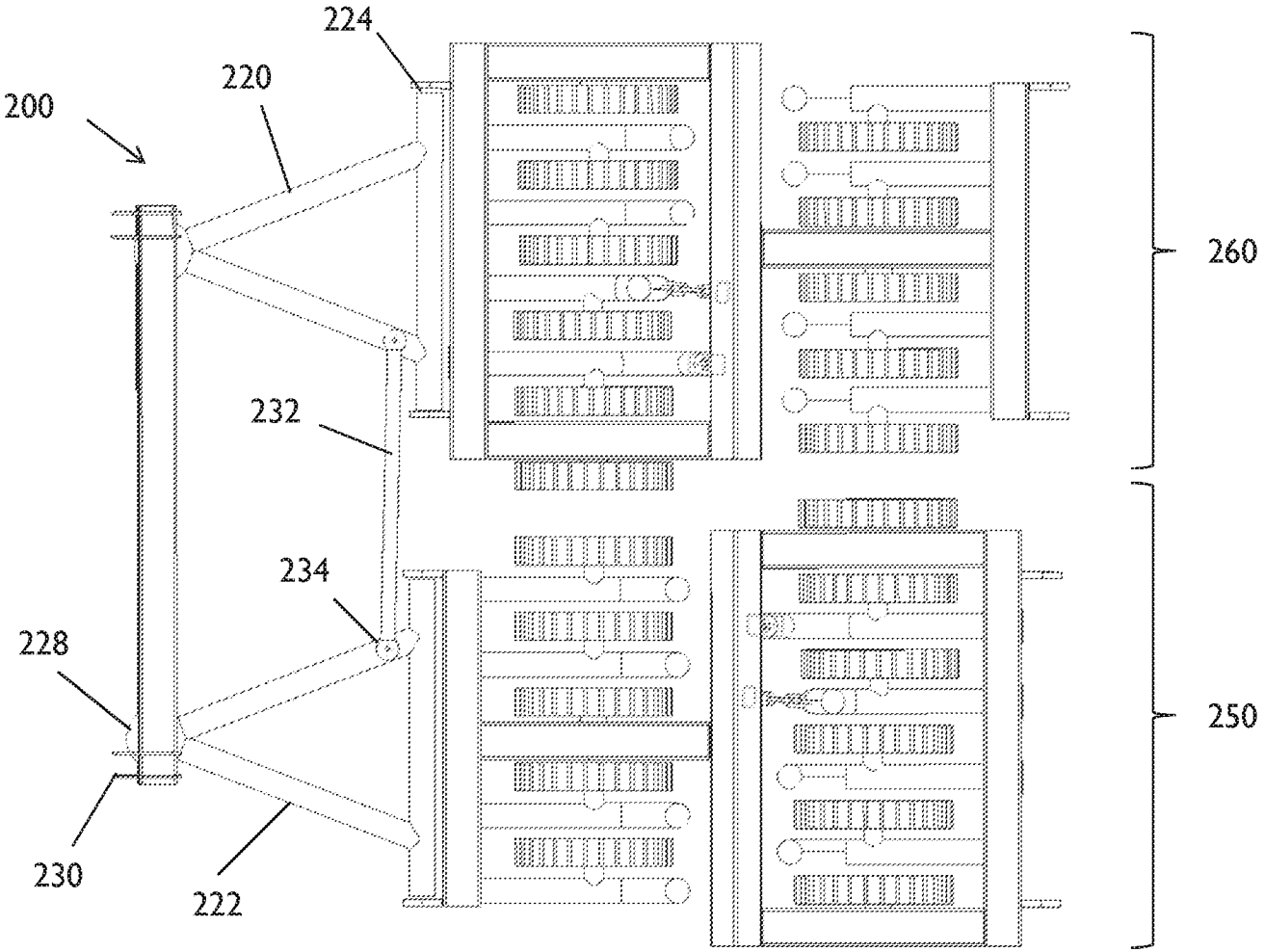
Figure 2C:
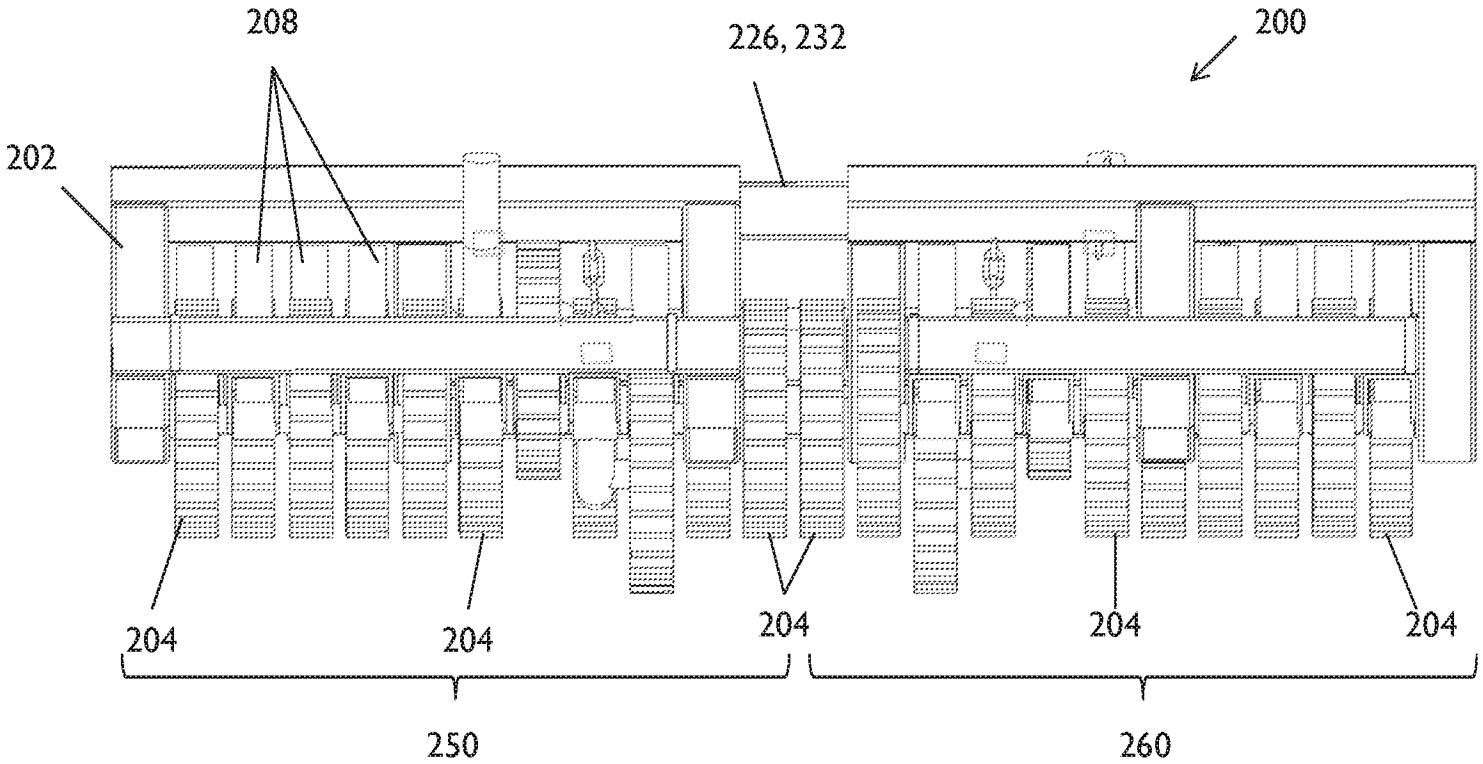

In this roller assembly (200) two roller gangs (250, 260) are positioned next to each other with one roller gang (250) facing in the direction of travel and the other roller gang (260) in the opposite direction. The staggered wheel patterns of both roller gangs nest together (see plan view of FIG. 2B). The staggered wheel patterns of both roller gangs generate a continuous row of wheels with the same gap between each wheel (see front view of FIG. 2C).

Figure 2D:
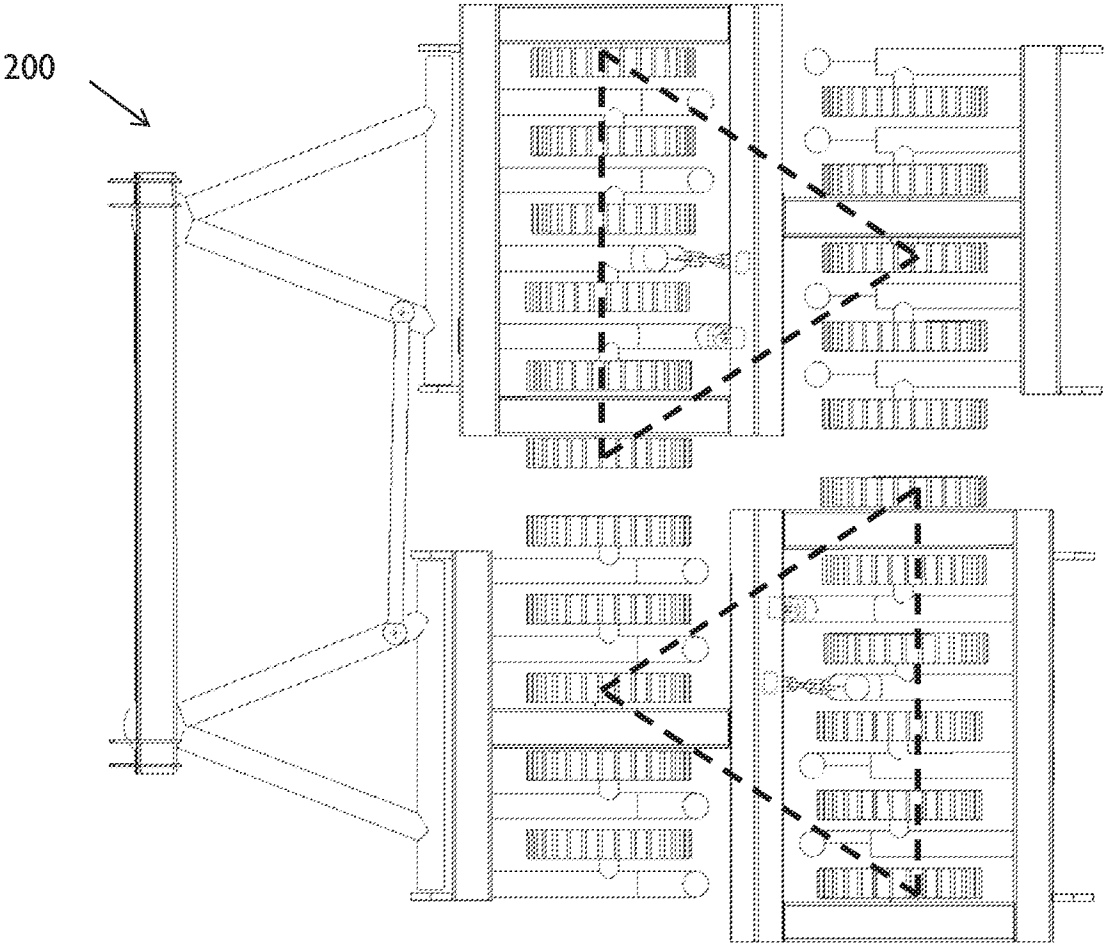

FIG. 2D shows the three fixed wheels (204) of each roller gang arranged in a widely spaced triangle. The triangular spacing is such that these wheels (204) and the frame (202) create a stable three wheeled vehicle for each roller gang. One roller gang (250) is arranged facing in the direction of travel and the other roller gang (260) in the opposite direction.

Each roller gang (250, 260) is pushed ahead of a vehicle by a boom (220, 222). The boom (220, 222) is pivotally attached to the roller gang frame (202) via pivotal attachment points (224). Each boom (220, 222) is attached to a vehicle bracket (226) by a ball joint (228). The vehicle bracket comprises attachment points (230) for attachment to the vehicle.

A tie rod (232) connects the two booms (220, 222) together by attaching (via ball joints 234) to each boom. Thus the roller gangs (250, 260) are free to pivot and roll individually but the separation between them is maintained approximately constant.

Figure 2E:
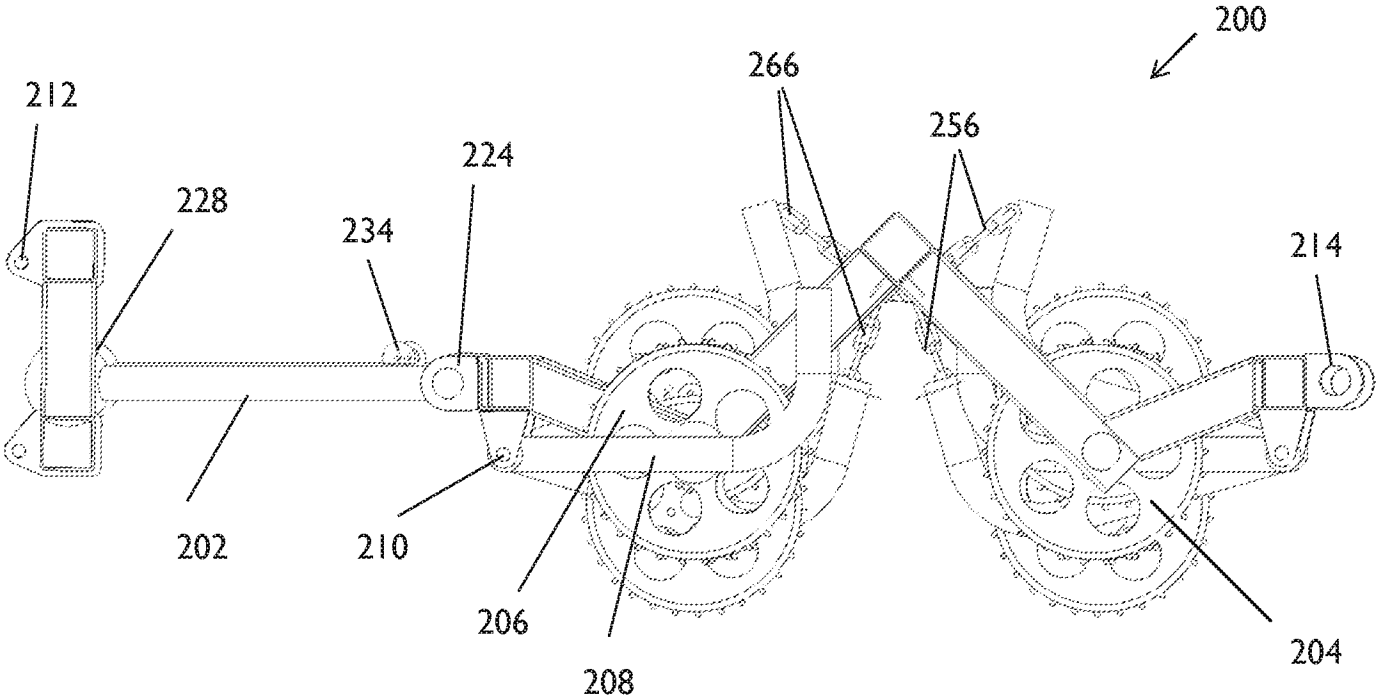

FIG. 2E shows a side view of the roller (200). For the roller gang (250) facing in the direction of travel each chain (256) is visible where the pivoting arms (208) connect to the frame (202). Each chain (266) is also visible for the other roller gang (260) in the opposite direction.

An extended system of the roller may have a powered 'steering' actuator to control the left/right position of the roller (200) ahead of the vehicle.

The system may have a functionality to pushdown/lift up one or other of both of the front or rear row of roller wheels.

Although an illustrative embodiment of the invention has been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

I claim:

1. A roller gang for mine clearance, the roller gang comprising:

a frame;

at least three fixed wheels, wherein the fixed wheels are directly attached to the frame, the fixed wheels being fixed relative to the frame;

a plurality of pivoting arms, wherein each of the pivoting arms is attached to the frame; and a plurality of remaining wheels, wherein the remaining wheels are respectively attached to the plurality of pivoting arms, the remaining wheels being movable relative to the frame.

2. A roller gang according to claim 1, wherein the at least three fixed wheels are attached to the frame in a generally triangular arrangement.

3. A roller gang according to claim 1, wherein the remaining wheels are arranged in two sets of parallel wheels.

4. A roller gang according to claim 3, wherein the remaining wheels have an attachment point with the pivoting arms to satisfy a load distribution requirement for the remaining wheels and/or the fixed wheels.

5. A roller gang according to claim 1, wherein the plurality of pivoting arms are bent to prevent the ends of each of the pivoting arms from hitting the ground and whilst still satisfying a required load distribution.

6. A roller gang according to claim 1, wherein the remaining wheels are attached to the respective pivoting arms at a location along the pivoting arms such that ground contact load under all wheels in the gang is substantially identical.

7. A roller gang according to claim 1, wherein the remaining wheels attached to the respective pivoting arms can individually move up and down to maintain contact with rough terrain over which the apparatus is traversed.

8. A roller gang according to claim 1, wherein the pivoting arms are heavier than the frame, fixed wheels and remaining wheels.

9. A roller gang according to claim 1, wherein one or more of the fixed wheels and/or the remaining wheels is offset in height with respect to the other of the fixed wheels and/or the remaining wheels.

10. A roller gang according to claim 1, wherein a total number of the fixed wheels comprises an odd number of wheels.

11. A roller gang according to claim 1, wherein at least one of the pivoting arms is further connected to the frame by a tether.

12. A roller gang according to claim 1, further comprising a boom attached to the frame.

13. A roller for mine clearance, the roller comprising at least two roller gangs according to claim 1.

14. A roller according to claim 13, wherein the at least two roller gangs are positioned adjacent each other with one roller gang facing in a direction of travel and the other roller gang facing in an opposite direction.

15. A roller according to claim 13, wherein the at least two roller gangs are aligned to form at least two substantially continuous rows of wheels.

16. A roller according to claim 15, wherein the at least two continuous rows of wheels have a gap between adjacent wheels that is substantially the same.

17. A roller according to claim 13, wherein the at least two roller gangs are pivotally attached to a respective boom.

18. A roller according to claim 17, wherein the at least two roller gangs are free to pivot and roll individually whilst maintaining an approximately constant separation between the at least two roller gangs.

19. A roller according to claim 18, further comprising a powered actuator for steering the roller.

20. A roller according to claim 19, wherein the roller is steerable between left and right positions of the roller ahead of a vehicle.

21. A roller according to claim 13, further comprising a mechanism to push-down and/or lift-up at least one of the rows of roller wheels.

22. A mine roller comprising one or more roller gangs, wherein each gang includes three wheels fixed directly to a frame and one or more further wheels are provided, the one or more further wheels are attached to heavy pivoting arms, the pivoting arms being attached to the frame.

23. A roller gang according to claim 1, wherein a total number of the remaining wheels comprises an odd number of wheels.

24. A roller gang according to claim 1, wherein a total number of the fixed wheels and the remaining wheels comprises an odd number of wheels.

* * * * *